US005544813A

United States Patent [19]

Giles et al.

[11] Patent Number: 5,544,813

[45] Date of Patent: Aug. 13, 1996

[54] ADJUSTABLE SPRAY SYSTEM AND ASSEMBLY METHOD

[75] Inventors: Durham K. Giles; David C. Slaughter, both of Davis, Calif.

[73] Assignee: Regents of the University of California, Oakland, Calif.

[21] Appl. No.: 410,013

[22] Filed: Mar. 22, 1995

Related U.S. Application Data

[63] Continuation of Ser. No. 154,918, Nov. 17, 1993, abandoned.

[51] Int. Cl.[6] ..... B05B 15/08

[52] U.S. Cl. ..... 239/71; 239/176; 239/390; 239/566; 239/587.5; 239/590.5; 239/600

[58] Field of Search ..... 239/71, 74, 171, 239/172, 390, 391, 397, 566, 568, 570, 587.1, 587.5, 590, 590.3, 590.5, 596, 600, 162, 176, 551; 285/319, 322, 323

[56] References Cited

U.S. PATENT DOCUMENTS

| | | | |
|---|---|---|---|
| 2,252,132 | 8/1941 | Mazveskas et al. . | |
| 2,618,511 | 11/1952 | Wahlin . | |
| 2,629,632 | 2/1953 | Munson | 239/590.5 X |
| 2,639,194 | 5/1953 | Wahlin | 239/590.3 X |
| 2,647,801 | 8/1953 | Lycan | 239/590.3 |
| 2,672,187 | 3/1954 | Smith . | |
| 3,199,786 | 8/1965 | Waldrum | 239/172 X |
| 3,202,360 | 8/1965 | O'Brien | 239/596 X |
| 3,630,444 | 12/1971 | Nelson | 239/590.3 X |
| 3,632,043 | 1/1972 | Kirschmann | 239/172 X |
| 3,653,689 | 4/1972 | Sapy . | |
| 3,705,693 | 12/1972 | Franz . | |
| 3,779,462 | 12/1973 | Bruninga | 239/390 X |
| 3,799,453 | 3/1974 | Hart . | |
| 4,005,883 | 2/1977 | Guest | 285/322 |
| 4,068,867 | 1/1978 | Rodgers et al. . | |
| 4,161,280 | 7/1979 | Kasinskas | 239/172 X |
| 4,185,781 | 1/1980 | O'Brien . | |
| 4,313,331 | 2/1982 | Mode . | |
| 4,438,884 | 3/1984 | O'Brien et al. . | |

(List continued on next page.)

FOREIGN PATENT DOCUMENTS

| | | | |
|---|---|---|---|
| 1090426 | 3/1955 | France | 239/600 |

OTHER PUBLICATIONS

Catalogue from Legris, Inc. of Rochester, New York, titled "Stainless Steel" (8 pages) Dec. 1987.

Catalogue from Legris, Inc. of Rochester, New York, titled "Push to Connect Fittings" (16 pages) Jun. 1988.

3 pages from Legris, Inc.'s catalogue, "The Legris LF 3000 Cartridge Program" and other connectors. Mar. 1989.

3 pages from Polymatic's catalogue on instant fittings, undated.

*Primary Examiner*—Andres Kashnikow

*Attorney, Agent, or Firm*—Allston L. Jones

[57] ABSTRACT

A cartridge for use in a spray system, and for releasable connection to a quick-release coupling to form a nozzle assembly. The cartridge includes a generally elongated and hollow body member having a proximal end and a distal end. A nozzle tip is retained at the distal end of the cartridge, and the proximal end is adapted to fit, at least in part, within the quick-release coupling. The body member includes a shoulder for retaining the nozzle tip. In a basic embodiment, the cartridge includes a generally hollow tubular spacer which fits, at least partially, inside the body member, for pressing the nozzle tip against a shoulder formed by the body member at the distal end. An O-ring is disposed between the shoulder and the spacer, in order to seal the cartridge and to prevent leakage. A screw fits within the proximal end of the body member for retaining the spacer in tight engagement with the nozzle tip. In other embodiments, the cartridge includes a plurality of components, such as a sequence of filters and a check valve. The basic embodiment of the cartridge is assembled by fitting the O-ring on the nozzle tip; by inserting the nozzle tip inside the body member; by introducing a spacer inside the body member for abutting against the nozzle tip; and by advancing the hollow screw within the body member to securely retain the spacer against the nozzle tip.

36 Claims, 8 Drawing Sheets

U.S. PATENT DOCUMENTS

| | | | |
|---|---|---|---|
| 4,456,180 | 6/1984 | Lury | 239/600 X |
| 4,508,369 | 4/1985 | Mode . | |
| 4,527,745 | 7/1985 | Butterfield et al. . | |
| 4,570,858 | 2/1986 | Bintner et al. | 239/71 X |
| 4,588,214 | 5/1986 | Guest | 285/323 |
| 4,606,783 | 8/1986 | Guest | 285/323 |
| 4,807,911 | 2/1989 | Short | 285/323 |
| 4,848,672 | 7/1989 | Matsumoto et al. | 239/590.5 |
| 4,899,937 | 2/1990 | Haruch | 239/590.3 X |
| 5,002,230 | 3/1991 | Norskov et al. | 239/570 X |
| 5,110,048 | 5/1992 | Waldrum | 239/171 |
| 5,174,611 | 12/1992 | Byrd et al. | 285/323 X |
| 5,297,824 | 3/1994 | Imhof et al. | 285/322 |

ADJUSTABLE SPRAY SYSTEM AND ASSEMBLY METHOD

STATEMENT OF GOVERNMENT RIGHTS

This invention was made with Government support under Grant No. 5212-H awarded by USDA. The Government has certain rights in this invention.

This is a continuation of copending application of Ser. No. 08/154,918, filed on Nov. 17, 1993, now abandoned.

BACKGROUND OF THE INVENTION

The present invention relates in general to fluid delivery systems, and more particularly, to spray nozzles and spray system assemblies which are susceptible to quick coupling to, and uncoupling from, a variety of fluid delivery systems.

Spray nozzle assemblies are used, for example, in several industrial, agricultural and commercial applications in which it is necessary to remove the spray tips for various reasons, such as inspection, cleaning, replacement of worn spray tips, or substitution of spray tips to change the spray pattern or discharge rate. It is therefore important that such spray nozzle assemblies be quickly and easily assembled to, and disassembled from the fluid delivery systems.

Many nozzles have been proposed and marketed; however, the assembly and disconnection of these nozzles is generally not readily possible without skill and tools, which may be costly and inconvenient. Such nozzles are exemplified by U.S. Pat. No. 3,705,693 to Frantz, entitled "Means for Sealing Fittings and Nozzle Assemblies at Extremely High Pressures" and U.S. Pat. No. 2,618,511 to Wahlin, entitled "Stirrup Nozzle", both of which are incorporated by reference.

The Frantz patent describes means for sealing joints subjected to extremely high fluid pressures in the order of 70 thousand pounds per square inch. An elastic member is subjected to moderate mechanical pressure by the components of the joint to be sealed, and then it is subjected to extremely high fluid pressure, whereby the elastic member is deformed between the components of the joint so as to seal the joint against leakage. However, this sealing means is not used for nozzle attachment, alignment or quick uncoupling.

The Wahlin patent relates to a stirrup nozzle for attachment to fluid supply pipes. The nozzle includes a nozzle body and a loop or stirrup extension which encircles the tube. At the stirrup end the nozzle body is internally threaded to accommodate a threaded plug, and the pipe is provided with an opening through the side wall thereof to receive an outer end portion of the plug. However, this nozzle design requires tools for uncoupling and alignment.

Although various conventional quick disconnect nozzle couplings have been prepared for pipe connections, the orientation of these nozzles within the couplings cannot be easily adjusted. In this respect, agricultural sprayer systems often operate in adverse environments with poorly defined and highly variable target geometries. The operating parameters of the agricultural field sprayers are typically set by the operator at the start of the season and seldom, if ever, modified for changes in the target crop.

As the crop morphology changes due to the plant growth or simple variation within the field, the desired application rate and placement of the spray droplets may vary accordingly. In areas of the field where spray target volume, mass or area is sparse, excessive material may be released and correspondingly, in areas of dense target, poor spray deposition may result in reduced biological efficacy of applied spray materials.

The following patents illustrate representative conventional nozzle assemblies which require tools for nozzle adjustment: U.S. Pat. No. 4,527,745 to Butterfield et al., entitled "Quick Disconnect Fluid Transfer System"; U.S. Pat. No. 4,438,884 to O'Brien et al., entitled "Quick Disconnect Nozzle"; U.S. Pat. No. 4,185,781 to O'Brien, entitled "Quick Disconnect Nozzle Connection"; U.S. Pat. No. 3,799,453 to Hart, entitled "Quick Disconnect Nozzle"; and U.S. Pat. No. 2,618,511 to Wahlin described above, all of which are incorporated by reference.

The Butterfield patent describes a quick disconnect spray nozzle assembly supplied with liquid from a pipe. The nozzle assembly includes a main body member forming a nipple which extends into the pipe through a hole in the wall of the pipe. Pressurized liquid within the pipe enters the nipple and passes downwardly through a central fluid passageway in the body member for discharge through a spray tip.

In order to lock the cap and the spray tip on the lower end of the body member, a pair of lugs on the body member cooperate with a pair of positioning and locking slots in the cap. This positioning of the cap sets the rotational position of the spray tip and, therefore, the direction of the spray pattern. Thus, the nozzle tip is tightly secured to the cap, and the orientation of the tip requires a corresponding orientation of the cap, which would require significant effort, special tools and trained applicators. In order to uncouple the cap, a biasing force is applied to the cap.

The O'Brien Pat. No. 4,438,884 illustrates a quick disconnect nozzle including a nozzle body and a nozzle tip. The nozzle body may be connected to a pipe and the nozzle tip is separable from the nozzle body by a twist type action. The tip is locked in the body by an interlocking engagement between undercut shoulders on the nozzle body and a pair of rounded projections on the nozzle tip which are engaged under the opposing shoulder by a twisting action.

This interlocked relationship is maintained by a sealing member which seals the connection between the nozzle body and the tip and exerts pressure therebetween. As a result of this rigid interlocked relationship between the nozzle tip and body, the orientation of the tip cannot be readily accomplished without tools and trained applicators. Moreover, the spray tip and retaining ring cannot be used without the exact mating nozzle body usually produced by and available from only a single manufacturer.

U.S. Pat. No. 4,185,781 to O'Brien describes another quick disconnect nozzle connection for a spraying tip and a nozzle body. The spraying tip is defined by a cylindrical inlet stem at one end of the tip. An arcuate section extends radially outwardly from the cylindrical surface of the stem and includes a recess. Retention segments extend radially inwardly over a cylindrical chamber adapted to receive the arcuate section of the spraying tip.

Each retention segment is adapted to mate with a corresponding recess in the arcuate section, in order to lock the nozzle body. A spring disposed between the nozzle body and the spraying tip maintains the body and tip in a locked relationship. Consequently, the patented nozzle design lacks orientation flexibility for the spraying tip.

The Hart patent describes yet another quick disconnect nozzle that is primarily intended for irrigation sprinklers. The nozzle includes a threaded fitting for connection to a sprinkler outlet having diametrically disposed L-slots. Each slot has a yieldable member having a yieldable wall provided with a retainer projection, and a nozzle member having diametrical pins for mating with the L-slots and interlocking with the fitting.

In none of the above systems can the spray nozzle be positioned or adjusted without shut-off of the liquid flow and removal of the nozzles or manual adjustment of the nozzle body using tools.

Another common attempt to address the nozzle orientation concern is to use multiple nozzle assemblies, such as three or even more at the same location as in Spraying Systems Co. TeeJet Part No. 24216, with different nozzle orientations or spray tip sizes. A typical conventional agricultural spray boom includes between 50 to 100 nozzles, while a cooling system in industrial applications could include 500 or more nozzles per duct. Obviously, this duplication of elements contributes to a substantial increase in the cost of fluid transfer systems, and the expense of maintaining such systems. Moreover, the spray tip alignment or position within each separate nozzle assembly cannot be adjusted without shut-down of the liquid spray flow and removal of the spray tips.

Thus, the need has become apparent for a single nozzle assembly which, in addition to being readily connectable to, and disengageable from a fluid transfer system by hand, should allow for a quick and precise nozzle orientation, without using special tools, shut-down of the spray liquid flow or removal of the nozzles. Such nozzle assemblies would, for instance, increase the accuracy and efficiency of the spray application process in order to reduce potential environmental pollution and decrease the overall amount of chemical applied.

As further illustrated by the Butterfield and Wahlin patents, complementary spraying parts, such as a filter or strainer and a check valve are conventionally inserted within the nozzle body. However, when maintenance is being performed on the site, in the field, and the nozzle member or cap is removed, these parts are loosely detachable and tend to readily self-disassemble. If found and recovered, cleaning and reorientation are necessary before refitting in the nozzle body to insure proper nozzle functioning. Additionally, the parts may become lost as they fall in dirt, foliage or rugged surroundings.

As a result, the applicator will need to remove his or her protective gloves to recover and clean the stray parts, sometimes placing them in the mouth to blow off the collected debris. As the soil might have already been sprayed with pesticides or other chemicals, conventional maintenance procedure could expose the applicator to hazardous situations.

Additionally, even if precautional measures are taken and the soiled parts were replaced with new parts, there remains the possibility of selecting and using the wrong size strainer, tip or valve. This mismatch may cause eventual clogging due to collected contaminants along the fluid path or improper operation of the spray system due to use of an incorrect check valve.

The logistics of replacing the parts of the nozzle assemblies, present yet another challenge, namely the lack of a uniform standard among the manufacturers. The replacement parts in conventional nozzle assemblies especially, the nozzle retaining cap and the nozzle body, should be purchased from the same manufacturers as the original parts, thereby significantly limiting the user's selection.

Therefore, it would be desirable to have a new nozzle assembly and a method of connecting it to a fluid delivery system. The nozzle assembly should securely house the tip, strainer, check valve and similar other components. It should further minimize the applicator's exposure to hazardous chemicals, and the likelihood of parts mismatch and malfunction. Additionally, the nozzle assembly should have a relatively simple design which encourages the setting of a uniform standard among the various manufacturers.

SUMMARY OF THE INVENTION

It is therefore an object of the present invention to address the foregoing concerns, and to provide adequate solutions thereto.

It is another object of the present invention to provide a new, simple, and relatively inexpensive nozzle assembly which is readily connectable to, and disengageable from a fluid transfer system by hand.

It is a related object of the invention to provide such an improved nozzle assembly which allows for quick and precise nozzle orientation, without using special tools.

It is a further object of the present invention to provide a single nozzle assembly which replaces the conventional multiple spray nozzle assembly, thus significantly reducing the overall cost and maintenance of the fluid delivery system.

It is yet another object of the present invention to provide a new nozzle assembly which securely houses the tip, strainer, check valve and similar other components, and thus ensures that these components do not easily separate one from the other when the nozzle assembly is uncoupled from the fluid transfer system.

It is an associated object for the nozzle assembly of the foregoing type to minimize the likelihood of parts mismatch and malfunction.

It is an additional object of the invention at hand to provide relatively simple and practical designs for a spray system, and a control method.

A further object of the present invention is to provide such an improved spray nozzle assembly which can be efficiently and economically mass manufactured.

Still a further object of this invention is to provide an improved spray nozzle assembly of the foregoing type utilizing a wide variety of different but interchangeable spray tips.

Briefly, the above and further objects and advantages of the present invention are achieved by an improved cartridge for use in a spray system, and for releasable connection to a quick-release coupling to form a nozzle assembly. The cartridge includes a generally elongated and hollow body member having a proximal end and a distal end. A nozzle tip is retained at the distal end of the cartridge, and the proximal end is adapted to fit, at least in part, within the quick-release coupling. The body member includes a shoulder for retaining the nozzle tip.

In a basic embodiment, the cartridge includes a generally hollow tubular spacer which fits, at least partially, inside the body member, for pressing the nozzle tip against a shoulder formed by the body member at the distal end. An O-ring is disposed between the shoulder and the spacer, in order to seal the cartridge and to prevent leakage. A generally hollow screw, or retaining ring, fits within the proximal end of the body member for retaining the spacer in tight engagement with the nozzle tip. In other embodiments, the cartridge includes a plurality of components, such as a sequence of filters and a check valve.

The basic embodiment of the cartridge is assembled by fitting the O-ring on the nozzle tip; by inserting the nozzle tip inside the body member; the metallic or ceramic tip could be also be molded into the plastic or a spray orifice could be drilled or formed directly in the plastic; by introducing a spacer inside the body member for abutting against the nozzle tip; and by advancing the screw or pressing a locking ring within the body member to securely retain the spacer against the nozzle or spray tip.

The basic embodiment of the cartridge includes a substantially uniformly elongated tubular segment which extends between the distal and proximal ends. In another embodiment, the body member includes an enlarged section at about its distal end to facilitate the handling of the body member.

In yet another embodiment, the body member terminates in a roughened section at about its distal end, for providing a gripping surface, in order to improve the handling of the body member and orientation of the spray tip. In a further embodiment of the cartridge, the body member terminates at about its distal end in a disc shaped lobe for engaging a torque transmission means, and for providing a convenient handle for manually rotating the body member.

In another embodiment, the body member includes an elongated tubular segment which comprises at about the distal end a plurality of peripheral grooves, and the cartridge further includes a plurality of rings which fit into corresponding ones of the peripheral grooves to provide a convenient gripping surface to the body member. These rings are color coded to provide a visual indication of the characteristics of the cartridge. For instance, one ring indicates the tip size, flowrate or angle, another one ring indicates the check valve pressure, and yet one or more other rings indicate the filter sizes.

In yet a further embodiment of the present invention, the body member includes an elongated tubular segment which comprises at about the distal end a plurality of generally identical and adjacently disposed gripping lobes for providing a convenient handle to the body member. A stabilizing device, such as a collar and a guide wire, or a resilient shroud, may be used to minimize the chance of misorientation of the nozzle tip. Additionally, one lobe may be color or shape coded to indicate the spray tip orientation within the cartridge.

The outer shape of the body member could also be specially designed to assume an aerodynamic contour, for use in aerial applications.

A spray system is also described and includes a plurality of T-shaped fittings. Each T-shaped fitting includes a first branch, a second branch and a third branch. The first branch is connected to a threaded nipple for connecting the fitting to a fluid supply system, and is capable of swiveling 360 degrees around a central axis. The second branch is connected to a cartridge of the type described above. The third branch is connected to an actuator cartridge, which, in turn, is connected to a drive linkage mechanism, for remotely controlling the nozzle orientation.

Therefore, the spray nozzle assembly enables easy and convenient removal and replacement of the spray tip, while at the same time ensuring an excellent seal to prevent the liquid being sprayed from leaking through the joints of the nozzle assembly. This improved spray nozzle assembly permits the spray tip to be installed and removed by the application of an axial force to the coupling of the assembly, without the necessity of simultaneously applying a twisting torque. Accurate positioning of the spray tip is ensured, and the desired orientation of the spray tip is precisely maintained. Moreover, the nozzle assembly can be efficiently and economically manufactured at high production rates, and can be used with a wide variety of different but interchangeable spray tips.

BRIEF DESCRIPTION OF THE DRAWINGS

The above and other features of the present invention and the manner of attaining them, will become apparent, and the invention itself will be better understood, by reference to the following description and the accompanying drawings, wherein.

DETAILED DESCRIPTION OF THE PREFERRED EMBODIMENTS

Figure 2:
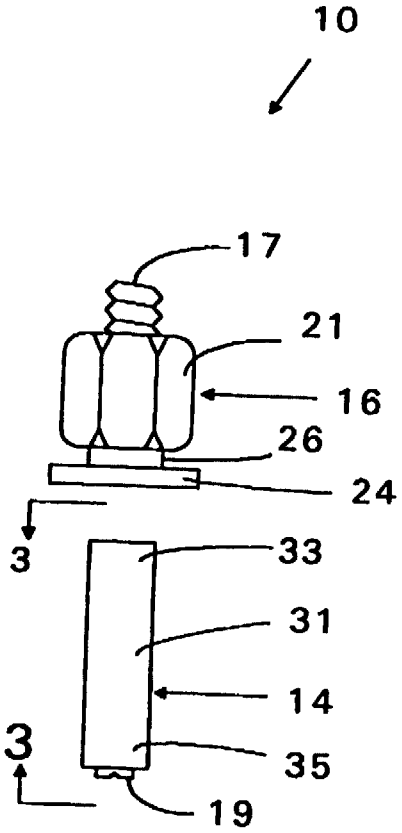
FIG. 2 is a schematic exploded view of the nozzle assembly of FIG. 1.
Figure 1:
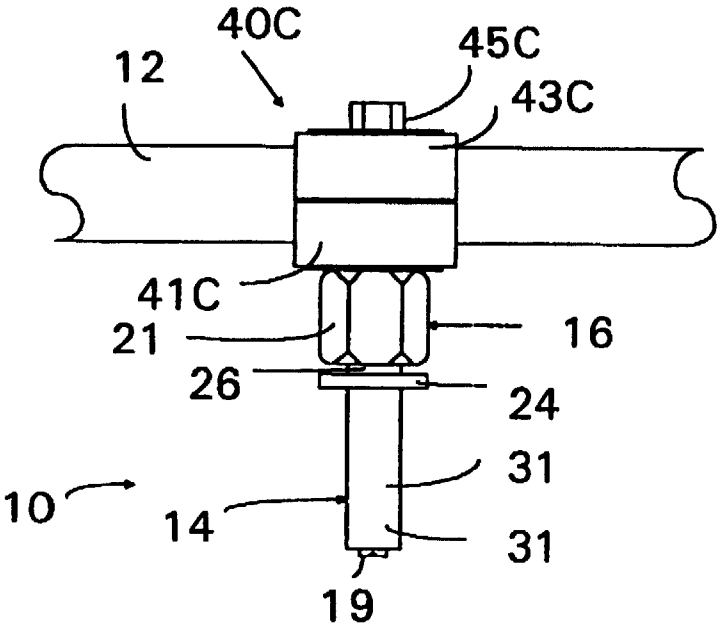
FIG. 1 is a schematic representation of a nozzle assembly embodying the present invention, mounted on a pipe.

Referring now to the drawings, and more particularly to FIGS. 1 and 2 thereof, there is schematically illustrated an improved nozzle assembly 10 supplied with spray fluid to be dispensed therethrough. Thus, the nozzle assembly 10 is suited for various applications, such as for irrigation and delivery of pesticides, fungicides, insecticides, defoliants, foliar fertilizers, cooling liquid, coating, paint and wax coating applied to fruits and other food products. The spray fluid is supplied from a pipe 12.

The nozzle assembly 10 generally includes a cartridge 14 which is releasably coupled to a quick-release coupling 16. A threaded nipple 17 extends from the quick-release coupling 16 for insertion into the pipe 12 through a corresponding hole (not shown) in the wall of the pipe 12. Pressurized fluid within the pipe 12 enters the nipple 17 and passes through a central fluid passageway in the quick-release coupling 16, for discharge along the axial length of the cartridge 14, through a spray tip 19. A wide variety of spray tips may be used in the illustrative nozzle assembly 10, for producing a multitude of differing spray patterns.

The quick-release coupling 16 used in the preferred embodiment of the present invention, is generally similar to the coupling described in U.S. Pat. No. 3,653,689 issued to Sapy and Legris, U.S. Pat. Nos. 4,313,331 and 4,508,369 issued to Mode and U.S. Pat. No. 4,068,867 issued to Rodgers et al., all of which are incorporated by reference. The quick-release coupling 16 is sold by Legris Company as the Instant Fitting Series 3100, Series 3800 and Cartridge Model LF 3000 and by the Nycoil Company as the Polymatic Instant Fitting Line Series 0900. The coupling 16 generally includes a hollow fitting 21 which is integrally connected to the nipple 17 at one end thereof, and which is connected to a collar 24 at its other end, via a telescoping neck 26.

The cartridge 14 accommodates the spray tip 19 and various other complementary components, as it will be described later in greater detail. The cartridge 14 generally includes an elongated hollow body member or sheath 31 which is open at one end 33 thereof, and which braces the spray tip 19 at its opposite end 35.

To establish connection between the coupling 16 and the cartridge 14, the end 33 is simply inserted into the collar 24, the telescoping neck 26 and the fitting 21, along the axial direction of the coupling 16. If the body member 31 were pulled out, or if the pipe 12 were pressurized, a radial retaining force is exerted on the end 33, and the body member 31 is securely wedged to the coupling 16. The greater the force applied to the body member 31, the firmer it will be anchored to the coupling 16. To disconnect the cartridge 14, the collar 24 is pressed against the fitting 21 and an axial thrust is applied to body member 31.

Additionally, when the pipe 12 is not pressurized, the body member 31 may swivel freely within, and is rotatably adjustable with respect to the fitting 21. As a result, the spray tip 19 may be easily oriented to a desired position, to obtain an optimal spray pattern.

Considering now the coupling 16 in greater detail, the fitting 21 is hexagonally shaped and is hollow throughout its axial length for allowing the spray fluid to flow therein. A clamping mechanism 40C fixedly secures the coupling 16 to the pipe 12. The clamping mechanism 40C includes a first clamping element 41C which fits around one half of the pipe 12, and cooperates with a second clamping element 43C that fits around the other half of the pipe 12. The two clamping elements 41C and 43C are drawn toward each other, and in engagement with the pipe 12, by conventional means such as a pair of screws 45C, which pass through the first clamping element 41C and are threaded into the second clamping element 43C. Alternately, the quick-release coupling 16 could be directed threaded into conventional pipe fittings (not shown) incorporated into the liquid supply pipe 12.

While a particular quick-release coupling 16 has been described, it should be understood to those skilled in the art that different types and models may be used.

Figure 3:
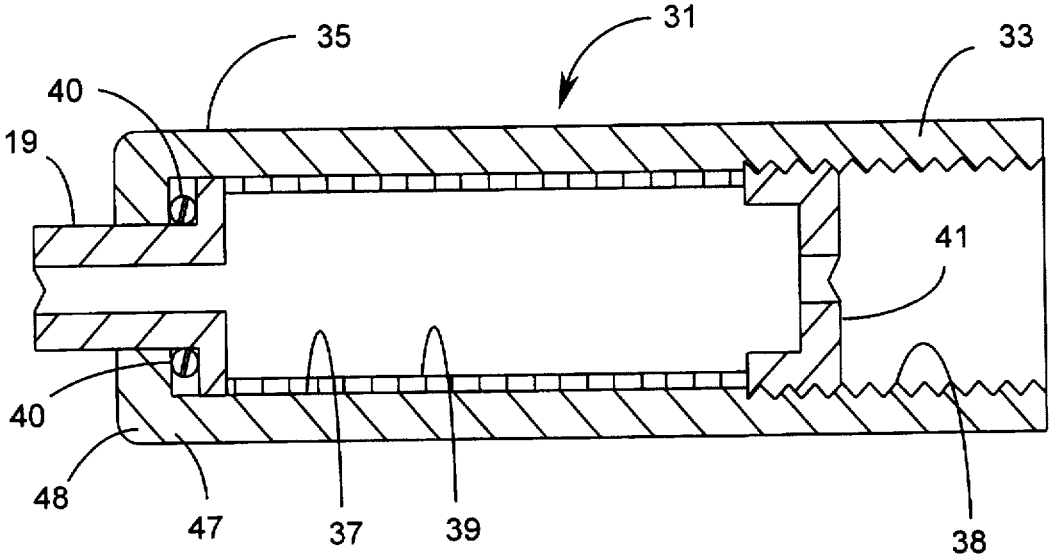
FIG. 3 is an enlarged cross sectional view of a first and basic embodiment of a cartridge forming a part of the nozzle assembly of FIGS. 1 and 2, taken along line 3—3 of FIG. 2.

Referring now to FIG. 3, there is illustrated an enlarged cross sectional view of the first and basic embodiment of the cartridge 14, taken along line 3—3 of FIG. 2. The body member 31 includes a uniformly elongated tubular housing 47 which extends between the two ends 33 and 35 of the cartridge 14. The housing 47 extends radially, inwardly and integrally, at the end 35, into a shoulder 48, for retaining the spray tip 19 inside the body member 31.

The body member. 31 is made of polymeric or plastic material. It should however be understood that other material could alternatively be used. For instance, the body member 31 could be made of one or a combination of the following materials: ferrous or non-ferrous metals, teflon, glass, ceramic or fiber.

The tubular housing 47 is about 4.5 centimeters long, and has an inner diameter of about 8 millimeters. It should be understood that other dimensions for the housing 47 may be selected. Additionally, while the tubular housing 47 is described as having a uniform cylindrical shape, other shapes are also contemplated within the scope of the present invention. Some of these shapes will be described below.

Figure 4:
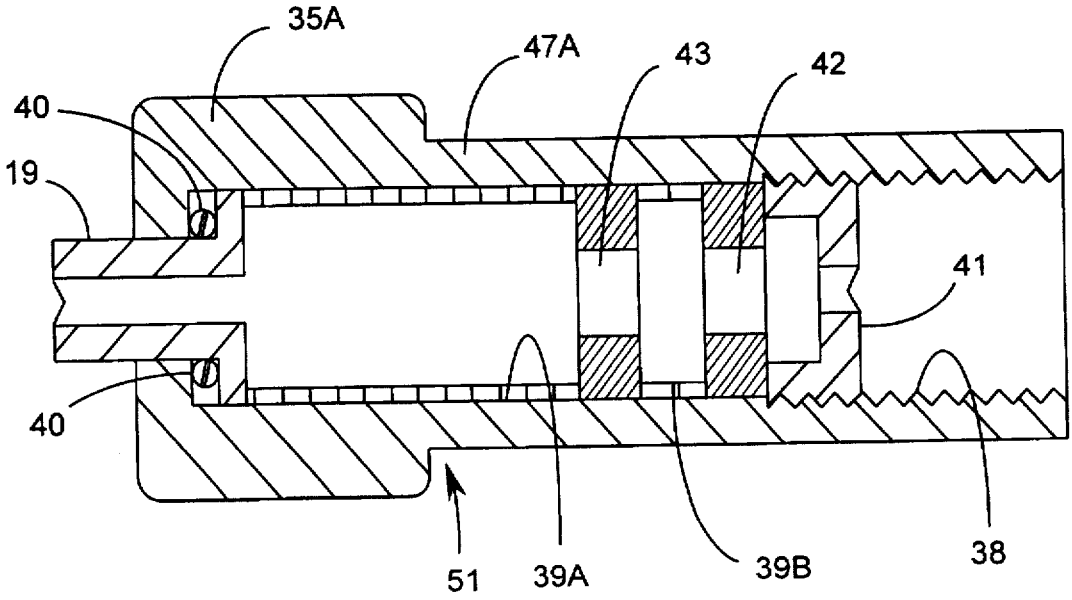
FIG. 4 is an enlarged longitudinal cross sectional view of a second embodiment of a cartridge shown encasing a coarse filter.
Figure 5:
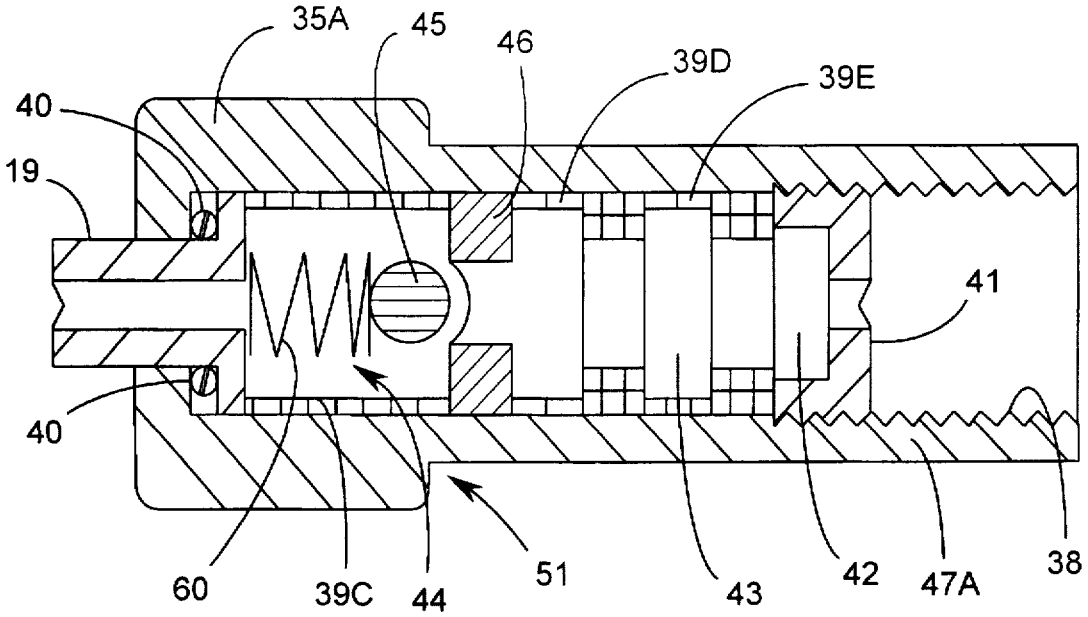
FIG. 5 is another view of the cartridge of FIG. 4, shown encasing a coarse filter, a fine filter and a check valve.

For illustration purpose, FIGS. 4 and 5 show a second cartridge 50, with a housing 47A having an enlarged end 35A, to facilitate the handling of a body member 51. This second embodiment will be described later in much greater detail.

Figure 6:
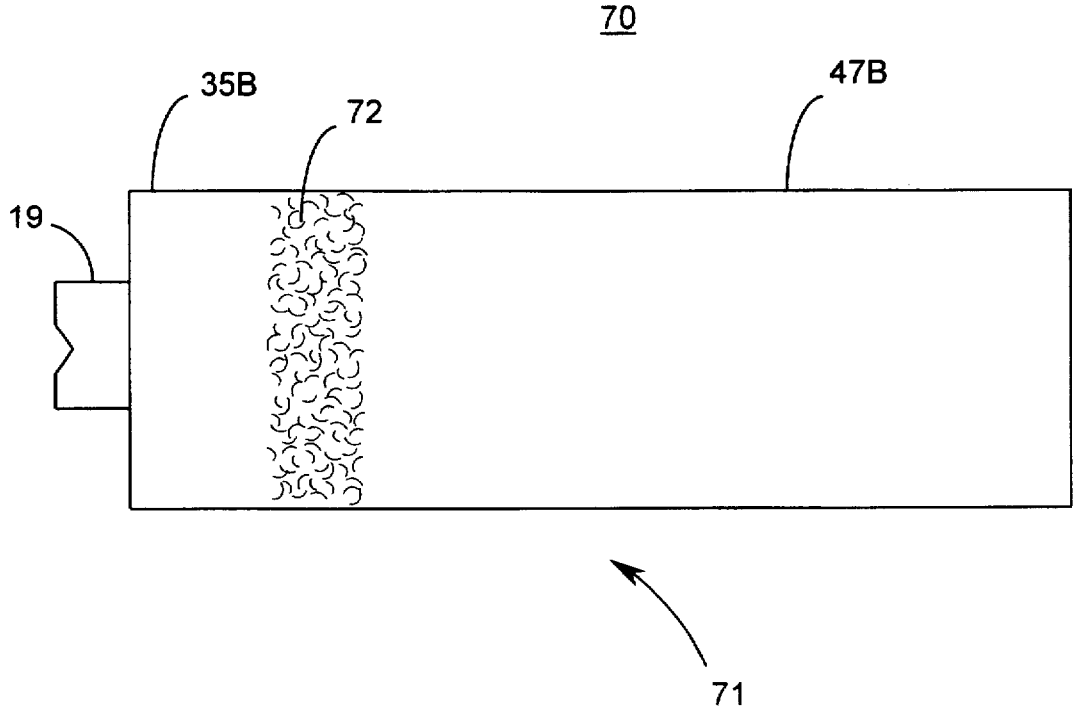
FIG. 6 is a side elevational view of a third embodiment of the cartridge.

FIG. 6 shows a side elevational view of a third cartridge 70, which is generally similar in design and construction to the cartridge 14. The third cartridge 70 generally includes a spray tip 19 retained in a predetermined oriented position by a body member 71. In turn, the body member 71 includes a tubular housing 47B which terminates at about its end 35B into a roughened section 72, for providing a gripping surface, in order to improve the handling of the body member 71 and orientation of the spray tip 19.

Figure 7:
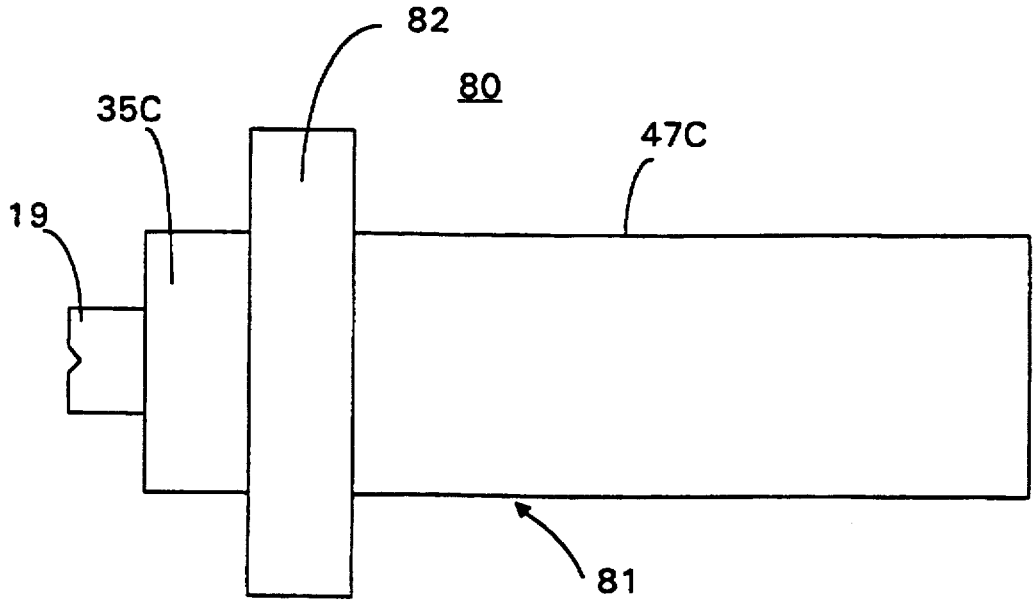
FIG. 7 is a side elevational view of a fourth embodiment of the cartridge.

FIG. 7 shows a side elevational view of a fourth cartridge 80, which is generally similar in design and construction to the cartridge 14. The fourth cartridge 80 generally includes a spray tip 19 retained in a predetermined oriented position by a body member 81. In turn, the body member 81 includes a tubular housing 47C which extends at about its end 35C into a circular disc shaped lobe 82 for engaging a torque transmission means such as a belt, gear or chain. As it will be explained later in relation to the adjustable spray system, the lobe 82 enables the fourth cartridge 80 to be remotely rotated for properly orienting the tip 19. Additionally, the lobe 82 provides a convenient handle for manually rotating the body member 81.

Figure 8:
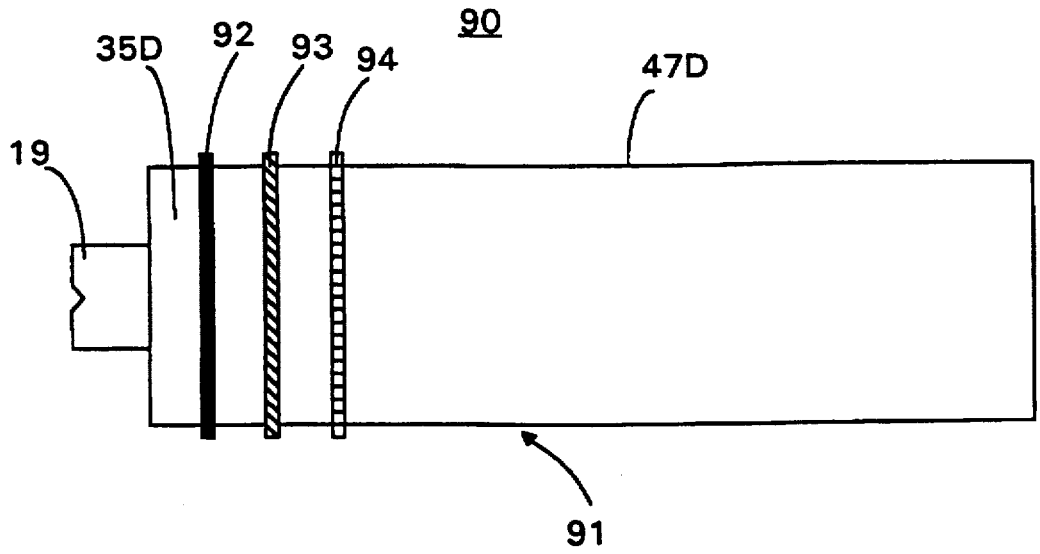
FIG. 8 is a side elevational view of a fifth embodiment of the cartridge.

FIG. 8 shows a side elevational view of a fifth cartridge 90, which is generally similar in design and construction to the cartridges 14 or 80. The fifth cartridge 90 generally includes a spray tip 19 retained in a predetermined oriented position by a body member 91. In turn, the body member 91 includes a tubular housing 47D which includes at about its end 35D a plurality of peripheral grooves (not shown). A plurality of rubber rings 92, 93 and 94 fit into the corresponding peripheral grooves to provide a convenient gripping surface to the body member 91.

Additionally, the rubber rings 92, 93 and 94 may be color coded, in order to provide a visual indication of various characteristics of the nozzle assembly 90. These characteristics include, for instance, position indication, spray tip flowrate, spray tip type, tip angle, check valve pressure or tension, coarse filter size or mesh and fine filter size or mesh. The fifth cartridge is shown, for illustration purpose to include three rings 92, 93 and 94. However, a different number of rings could be used without departing from the scope of the invention.

Figure 9:
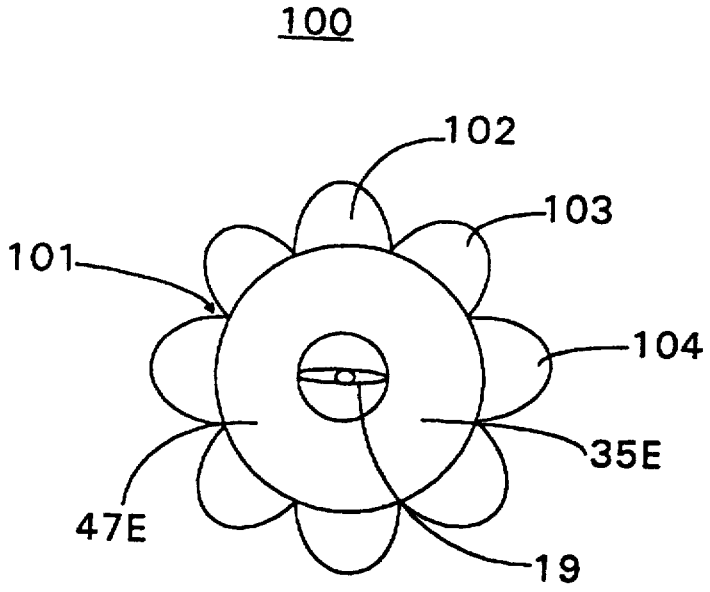
FIG. 9 is front view of a sixth embodiment of the cartridge.

FIG. 9 is front view of a sixth cartridge 100, which is generally similar in design and construction to the cartridges 14 and 50. The sixth cartridge 120 generally includes a spray tip 19 retained in a predetermined oriented position by a body member 101. In turn, the body member 101 includes a tubular housing 47E which includes at about its end 35E a plurality of generally identical and adjacently disposed gripping lobes, such as 102, 103 and 104, for providing a convenient handle to the body member 101. One of the lobes, for example, lobe 105, could be color or shape coded to indicate the spray tip orientation within the cartridge.

While six designs of the inventive cartridge have been illustrated, it should become clear to those skilled in the art, after reviewing the present disclosure, that other designs, or combinations of designs are contemplated within the scope of the present invention.

Returning now to the cartridge 14 of FIG. 3, the body member 31 is hollow throughout its entire axial length, and has a wall thickness of about 2.5 millimeters or such other dimension to allow the body member 31 to withstand the expected liquid pressure from the liquid delivery system. The inner wall of the body member 31 includes a smooth distal section 37, a corrugated or threaded proximal section 38, and the inner side of the shoulder 48.

A hollow tubular spacer 39 is fitted inside the distal section 37 for pressing the tip 19 against an O-ring seal 40. The O-ring seal 40 is pressed against the shoulder 48, in order to seal the cartridge 14 and to prevent leakage. The spacer 39 could be friction fit within the distal section 37. Another alternative would be to have the spacer 39 freely fit within the distal section 37, and to depend on a retaining screw 41 to keep the components compressed. Then, by removing the screw 41, the components could easily be removed for upgrade or repair.

The O-ring seal 40 could alternatively be eliminated by using close or interference tolerances between the cartridge 14 and the spray tip 19. The spray tip 19 could be cast or injection molded to the body member 31, when the cartridge 14 is manufactured.

The retaining screw 41 is generally hollow, and is screwed along the threaded proximal section 38, or a locking ring (not shown), is pressed along the section and retains the spacer 39 in tight engagement with the tip 19. As a result, the tip 19 is securely locked within the body member 31 by an interlocking engagement between the spacer 39 and the tip 19. The spacer 39 is engaged to, and disengaged from the tip 19, by the removal of the screw 41.

To assemble the cartridge 14, the O-ring 40 is fitted on the tip 19, which is then inserted inside the body member 31. The spacer is introduced inside the body member 31, and is advanced therein by the screw 41, until the O-ring 40 is wedged against the shoulder 48. Once assembled, the cartridge 14 becomes a unitary and integral component which could be easily replaced, cleaned and transported.

It should be noted that while the tip 19 is shown for illustration purpose to protrude from the body member 31, the tip 19 could be flush with or recessed from the outer surface of the shoulder 48, in order to give the entire nozzle assembly 10 a desired shape, and to further protect the tip 19 from dust accumulation. Several alternate spray tips could be used. For instance, hollow-cone nozzles are two-piece devices that would screw into the cartridge 14 instead of being pressed in. The spacer 39 forms a passageway for the fluid entering the spray tip 19. The shape of the passageway can be designed in such a way to control the pressure or the flow of the fluid, prior to entering the spray tip. Also, a pre-orifice (not shown) could be located ahead of the spray tip in order to reduce the fluid pressure at the spray tip, and to make the droplet size larger.

As is made clear from the above description, a significant advantage of the present invention is the use of standard and commonly available components, while offering a new and elegant solution to all the concerns presented by the conventional nozzle assemblies.

Referring now to the second cartridge 50 shown in FIG. 4, it contains the same components as the cartridge 14, i.e., the tip 19, the O-ring seal 40 and the screw 41. The cartridge 50 further contains a tubular and hollow spacer 39A, which serves a similar function to that of the spacer 39, and which further enables the retention of one or more auxiliary components, such as a sequence of filters to minimize clogging, by collecting contaminants which might block the aperture of the spray tip. Only two filters, a coarse filter 42 and a fine filter 43, are shown herein for simplicity of illustration.

According to one design, the spacer 39A has an integral structure which extends between the screw 41 and the tip 19, and which retains the coarse filter 42 and the fine filter 43 within the housing body member 51. An alternative design would be to have a first spacer 39A which extends between the tip 19 and the fine filter 43, and a second spacer 39B which extends between the fine filter 43 and the coarse filter 42. The spacer 39B maintains the two filters 42 and 43 spaced apart by a predetermined distance. The coarse filter 42 is caused to abut against the spacer 39E by means of the screw 41.

The cartridge 50 of FIG. 5 contains a check valve 44 which prevents leaks and drips. The valve 44 includes a ball 45, a ball seat 46 and a spring 60. When pressurized fluid flows through the body member 51, the fluid opens the valve 44 by pushing the ball 45 toward the tip 19. Otherwise, the spring 60 pushes the ball against the seat 46 and closes the valve 44. While a particular valve has been described, it should be understood that other valves may be used. For instance, a flexible diaphragm could replace the ball or a collapsible plastic cylinder could replace the ball and spring.

The cartridge 50 contains a first spacer 39C which is disposed between the seat 46 and the tip 19; a second spacer 39D which extends between the seat 46 and the fine filter 43; and a third spacer 39E which is disposed between the fine filter 43 and the coarse filter 42. Thus the first spacer 39A is simultaneously used to force the tip 19 against the shoulder 48, and as a sheath for the valve 44.

Figure 10:
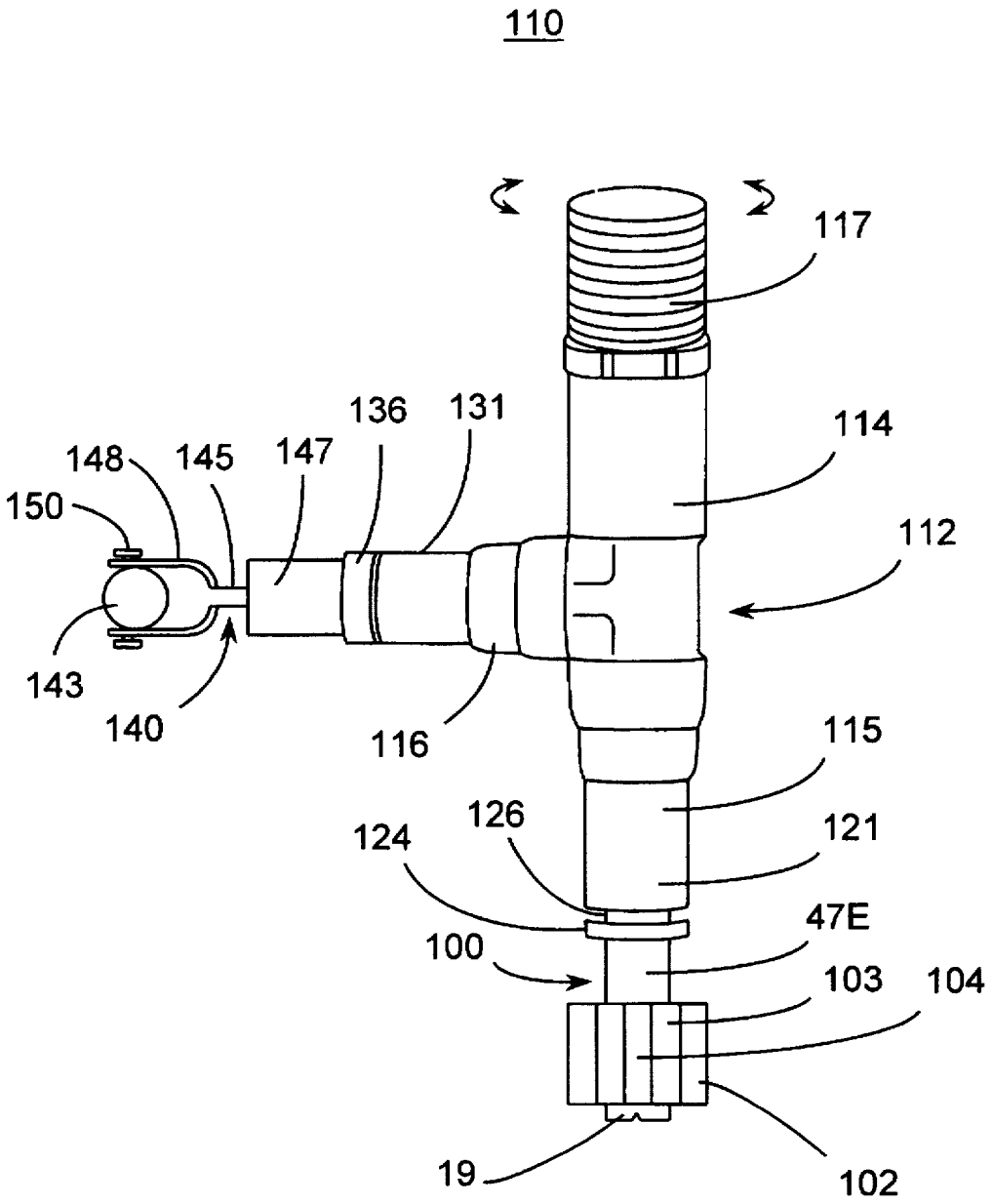
FIG. 10 is an enlarged perspective view of an adjustable T nozzle assembly employed in a spray system embodying the present invention, and using the cartridge of FIG. 9.

FIG. 10 is a perspective view of an adjustable multiple branch nozzle assembly 110 for use in a spray system embodying the present invention, and employing the cartridge 100 of FIG. 9. While the assembly 110 will be described as including a T- (or Tee-) shaped instant fitting 112, it should be understood that other multiple branch assemblies could be used. The instant fitting 112 is commercially available from the Legris Company as Series 0983, Series 3803, Series 3103 Instant Fittings and from the Nycoil Company as Series 57100 and Series 87100 Instant Fittings, and includes a first branch 114, a second branch 115 and a third branch 116.

The first branch 114 is connected to a threaded nipple 117, for attachment to the plumbing, such as the pipe 12. The fitting 112 is capable of swiveling 360 degrees around its central axis, relative to the nipple 117.

The second branch 115 extends linearly axially from the first branch 114, and functions in a similar way to the nozzle assembly 10. The second branch 115 includes a hollow tubular body member 121 that is functionally similar to the body member 31. A collar 124 is connected to a telescoping neck 126, and has a similar function to the collar 24.

A cartridge, such as the cartridge 100 is connected to the second branch 115, as explained above. The cartridge 100 includes a plurality of gripping lobes, such as the lobes 102, 103 and 104.

The third branch 116 extends orthogonally to the first and second branches 114 and 115, respectively, and is generally identical in function and design to the second branch 115. The third branch 116 includes a body member 131, and a collar 6 which is connected to a telescoping neck (not shown).

An actuator cartridge 140 is assembled to the third branch 116 for connecting the fitting 112 to a drive linkage mechanism 143, such that a remote manipulation of the drive linkage mechanism 143 will allow a precise orientation of the nozzle spray tip 19. In this regard, the actuator cartridge 140 includes a solid plastic rod 145 which is securely connected to, or molded on a metallic yoke 148. The yoke 148 is connected to the drive linkage mechanism 143 by means of a pin 150.

Therefore, as the drive linkage mechanism 148 is moved, it causes the third branch 116 of the fitting 112 to rotate relative to the central axis of the first and second branches 114 and 115. This rotational movement of the third branch 116 causes the fitting 112 and thus the cartridge 100 to rotate. Consequently, the tip 19 is rotated to the desired orientation.

One advantage of the T-nozzle assembly 110 is to allow the remote orientation of the tip 19. A further advantage of the assembly 110 is that the tip 19 can be oriented even when the T-nozzle assembly 110 is pressurized or functioning. The actuator cartridge 140 above is described as an example only, for illustration purpose. It should be understood that other actuating means could be used instead. For instance, the yoke 148 and the pin 150 could be replaced with a spherical ball bearing forming part of the drive linkage mechanism 143, and a corresponding fitting in which the ball bearing rotates, for transmitting the drive force to the fitting 112, thus causing the tip 19 to be oriented to form the desired spray pattern.

An important feature of the T-nozzle assembly 110 is to allow the width of the spray fan nozzles to be adjusted as a field sprayer travels along a row of plants.

Figure 11:
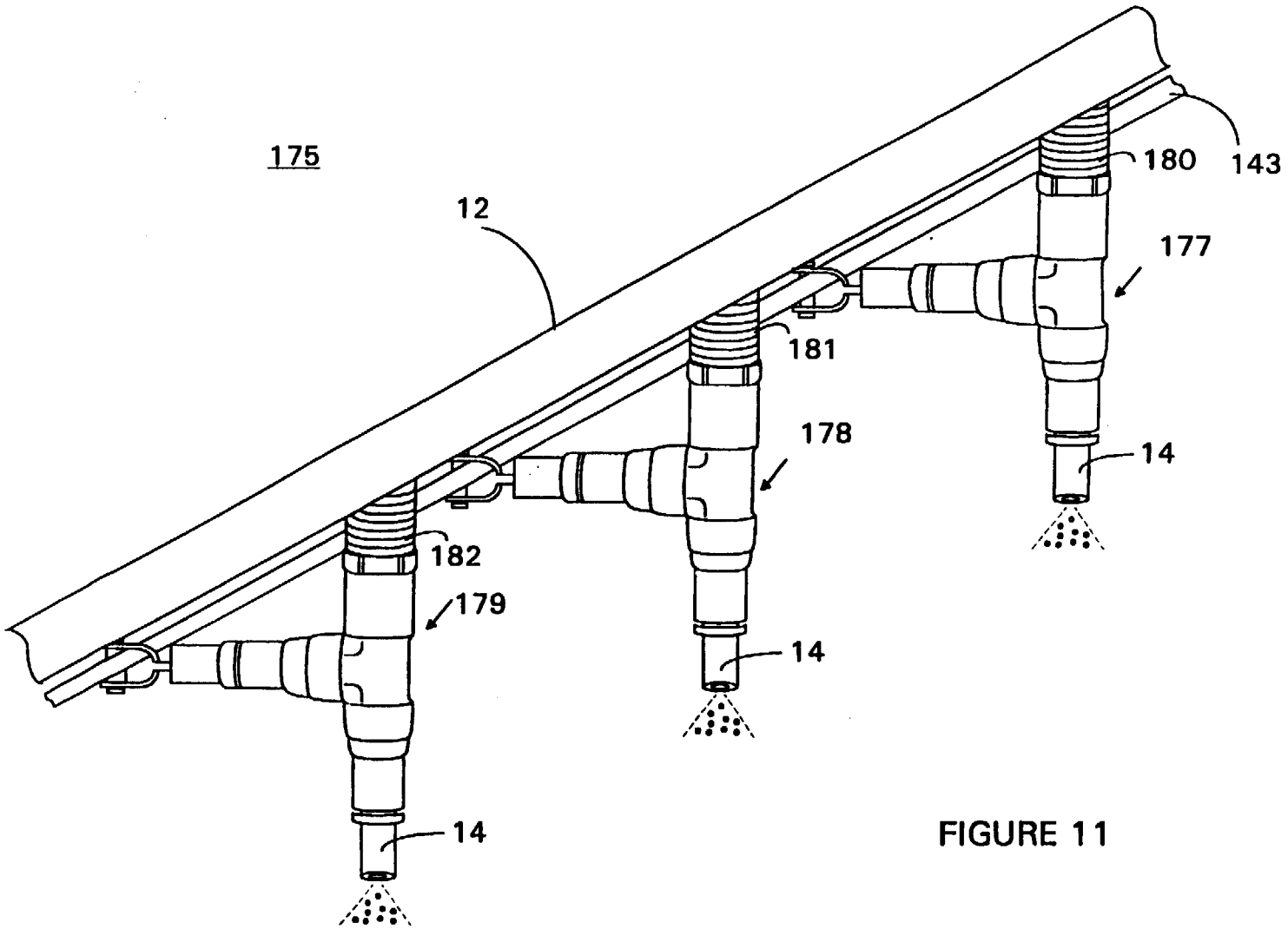
FIG. 11 is a schematic perspective view of the spray system comprising a plurality of T nozzle assemblies similar to the T nozzle assembly of FIG. 10.

Referring now to FIG. 11, there is illustrated an exemplary spray system 175 which comprises a plurality of T nozzle assemblies 177, 178 and 179, similar to the T nozzle assembly 110 of FIG. 10, but using the cartridge 14 of FIG. 3. While only three T nozzle assemblies are illustrated, it should be understood that other nozzle assemblies may be used.

FIG. 11 shows the three T nozzle assemblies 177, 178 and 179 connected to the pipe 12 through their respective nipples 180, 181 and 182. The drive linkage mechanism 143 includes a boom or rod which extends generally parallel to the pipe 12, for controlling the axial rotation of the T nozzle assemblies 177, 178 and 179.

One clear advantage of the adjustable spray system 175 is the reduction in the number of nozzle assemblies needed along the pipe 12. In the present embodiment, a single T nozzle assembly, such as the nozzle assembly 177, replaces several (for example three) conventional nozzle assemblies, and allows better control of the tip orientation and spray pattern. Such a device could be used in agricultural field spraying to direct output of the spray nozzles in narrow bands to cover young, small crops while avoiding spray deposition on the soil between rows of crop. Conversely, the system could be configured to spray only the soil areas between crops rows and avoid spray deposition on the plants. In either case, the spray orientation could be remotely controlled as the sprayer moved along.

In another embodiment of the spray system 175, the cartridges 14 are replaced with a plurality of cartridges 80 shown in FIG. 7. A second drive mechanism such as a continuous belt (not shown) connects the disc shaped lobes 82, in order to impart added flexibility to the spray system 175. Thus, the second drive mechanism directly controls the orientation of the tips 19, while the first drive mechanism comprising the boom 143 indirectly controls the tip orientation. Therefore, it is now possible to use the second drive mechanism for coarse tip orientation, while the first drive mechanism 143 is used for fine tip orientation. It should be noted that both the first and the second drive mechanisms could be remotely controlled.

Figure 12:
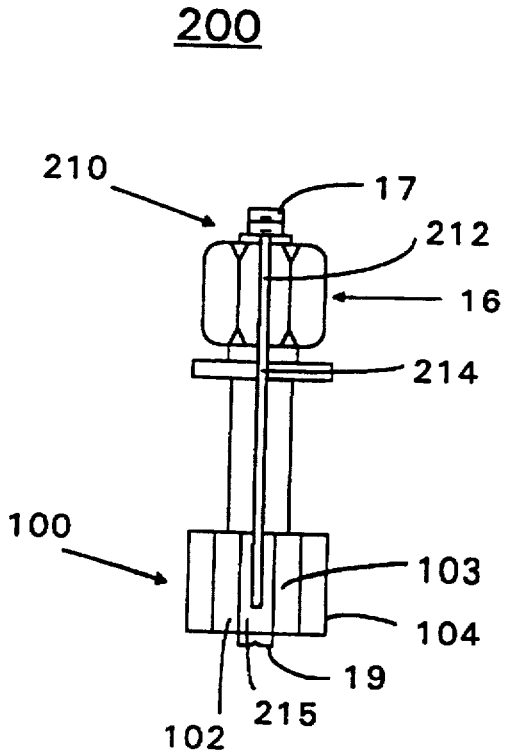
FIG. 12 is a schematic representation of a nozzle assembly using a stabilizing device and the cartridge of FIG. 9.

FIG. 12 is a schematic representation of a nozzle assembly 200 using the multi-lobe cartridge 100 of FIG. 9 and the quick-release coupling 16 of FIG. 2. When the fluid in the cartridge 100 is pressurized, the cartridge 100 is sealed into the instant coupling 16 and cannot easily rotate. When the fluid is not pressurized, the cartridge 100 can rotate, and the tip 19 can be oriented.

As a depressurized nozzle assembly 200 vibrates, vibration may cause the tip 19 to rotate. In order to minimize the chance of occurrence of such accidental rotation, a stabilizing device 210 is used. This device 210 includes a collar 212 which is fitted on the threaded nipple 17, and a guide wire 214 which extends from, and is connected to the collar 212. The guide wire 214 is partially nested within a groove 215 defined by two adjacent lobes, such as the lobes 102 and 103.

It would also be possible to use the foregoing stabilizing device 210 with other cartridge designs which would be modified to include a peripheral axial groove for retaining the guide wire 214.

Yet another alternative for the stabilizing device 210 would be to fit an elastic sleeve (not shown), such as a wide rubber band over part of the cartridge 100 and part of the coupling 16. This would be a desirable embodiment for more permanent installations where tip removal is not too frequent.

Figure 13:
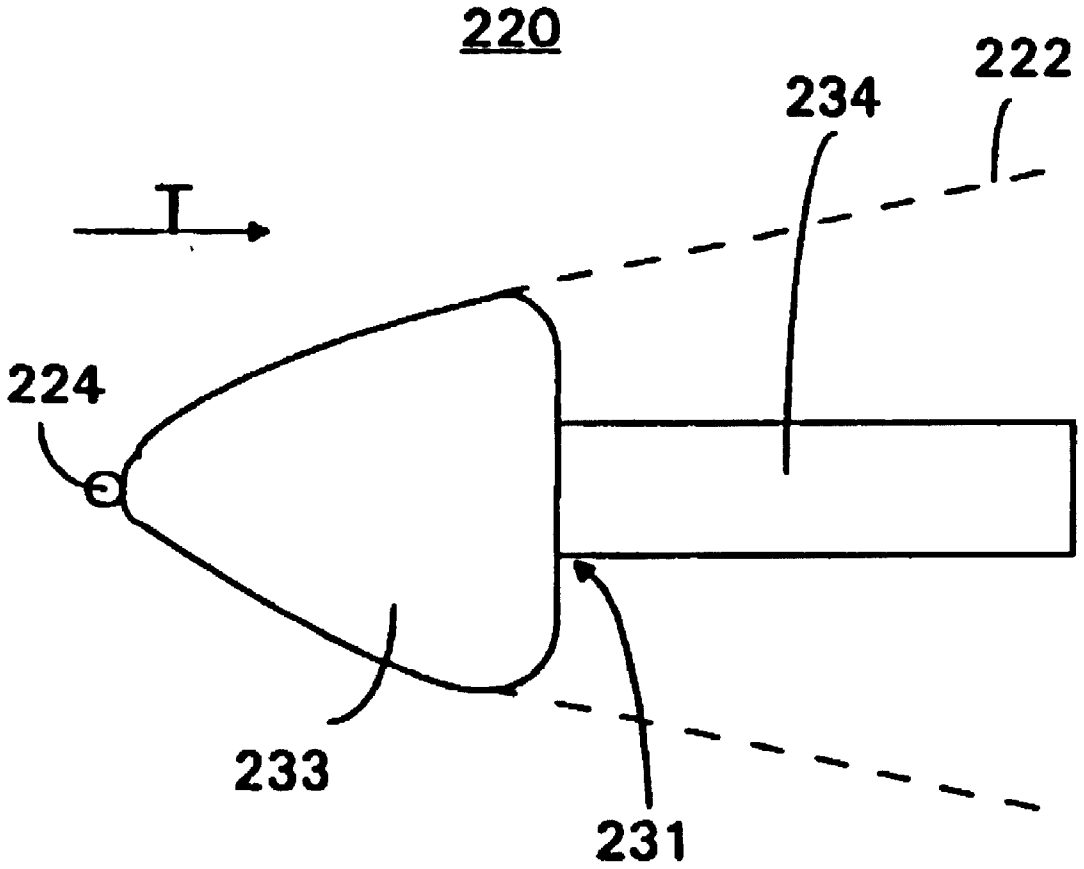
FIG. 13 is an enlarged schematic representation of an aerodynamically shaped cartridge for use in aerial spraying.

FIG. 13 is a schematic representation of an aerodynamically shaped cartridge 220 for special applications, such as aerial spraying. In conventional aircraft-applied spraying, an airfoil shaped boom 222 shown in phantom lines, is positioned beneath the aircraft wing. The arrow T indicates the direction of travel of the aircraft.

The cartridge 220 includes a nozzle or spray tip 224 and a body member 231. The body member 231 includes an aerodynamically shaped end section 233, which complements the shape of the boom 222, and which, after installation, generally becomes an integral part of the boom 222, thus minimizing turbulence and drag.

The cartridge 220 is further adapted for simple attachment to the boom 222. A hole is drilled in the boom 222, and a quick-release coupling (not shown) is inserted therein. A tubular insert 234 forming part of the body member 231 is fitted into the coupling.

The coupling could be embedded into the boom 222 and screwed thereto. Alternatively, a threadless coupling, similar to Legris Series LF3000 and Series 3800 compression installation fittings or Nycoil Poly-matic cartridges is inserted into the hole by means of an assembling pin (not shown). This particular coupling does not include a threaded nipple, and is wedged into the hole for secure attachment to the boom.

The present inventive nozzle assemblies, nozzle systems and corresponding methods of connection to fluid systems could be adapted for use in various applications. For instance, the foregoing nozzle assemblies could be used with fire extinguishers and spray guns as well as a multitude of other applications which require spraying of fluid through a nozzle tip.

While particular embodiments of the present invention have been disclosed, it is to be understood that various different modifications are possible and are contemplated within the scope of the specification, drawings, abstract and appended claims.

What is claimed is:

1. A unitary spray cartridge to be received in a cartridge retaining fitting of a delivery system, the delivery system providing a source of a material to be sprayed to said cartridge, the retaining fitting being configured to couple with the cartridge and hold and seal to the cartridge in use such that the engagement of the cartridge is completed by the application of a force along a cartridge receiving axis of the cartridge retaining fitting by pressing the cartridge toward the cartridge retaining fitting along the cartridge receiving axis and thereby holding said cartridge, said hold and seal being achieved without the necessity of simultaneously applying a twisting torque, the cartridge is held by the cartridge receiving fitting, and the retaining fitting is configured to uncouple from the cartridge by applying a release force to a release portion of the retaining fitting to uncouple the cartridge from the retaining fitting so that the cartridge can move along said cartridge receiving axis away from said retaining fitting without the necessity of simultaneously applying a twisting torque between the cartridge and the cartridge retaining fitting, the cartridge comprising:

an elongated tubular body member defining an interior passage therethrough wherein said body member has a proximal end configured to form a uniform tubular section to engage and be retained by the cartridge retaining fitting and when so engaged and retained to seal the interior passage for the material to be sprayed between the cartridge retaining fitting and an interior passage of said tubular body member and a distal end configured to hold a nozzle tip in communication with said interior passage of said body member and in a particular orientation with respect to said body member when the cartridge is in use and when the cartridge is being installed and removed from the cartridge retaining fitting.

2. The cartridge according to claim 1 wherein said distal end of said body member includes an inwardly extending shoulder to hold at least a portion of said nozzle tip within said distal end of said body member.

3. The cartridge according to claim 2, wherein said nozzle tip is held against said shoulder by a generally hollow tubular Spacer disposed within said interior passage of said tubular body member wherein said cartridge is configured to hold said spacer within said body member when the cartridge is in use and when the cartridge is being installed and removed from the cartridge retaining fitting.

4. The cartridge according to claim 3 further including a seal of a compressible material between said shoulder and said nozzle tip to seal the joint between the nozzle tip and the shoulder.

5. The cartridge according to claim 3 further including a retainer within said interior passage of said body member, said retainer and said body member being cooperatively configured to hold said spacer in tight engagement with the nozzle tip.

6. The cartridge according to claim 5 wherein a portion of an inner wall of said interior passage of said body member is configured to have screw threads therein;

wherein said retainer includes an outside surface configured with screw threads thereon to mate with said screw threads of said inner wall such that when said threads of said retainer are engaged with said threads of said inner wall and said retainer is rotated relative said body member said retainer moves along said inner wall either toward or away from said nozzle tip.

7. The cartridge according to claim 3 wherein said spacer defines an inner passageway, wherein said passageway is sized and shaped to control the flow or pressure of fluid delivered to said nozzle tip.

8. The cartridge according to claim 1 wherein said body member is made of a material that is formable into a generally elongated and tubular shape.

9. The cartridge according to claim 1 wherein said body member, near said distal end, includes an enlarged section to facilitate the handling of said body member.

10. The cartridge according to claim 1 wherein said body member, near said distal end includes a roughened section to facilitate the handling of said body member and the orientation of said nozzle tip.

11. The cartridge according to claim 1 wherein said body member, near said distal end, includes a disc shaped lobe disposed to be engaged by a torque transmission means, and to provide a convenient handle disposed to be manually manipulated to provide selected rotation to said body member.

12. The cartridge according to claim 1 wherein said body member, near said distal end, defines a plurality of spaced-apart peripheral ring grooves; and said cartridge further includes a plurality of rings sized and shaped to be retained by a corresponding one of said peripheral grooves defined by said body member to provide a gripping surface on said body member.

13. The cartridge according to claim 12 wherein at least one of said plurality of rings provides a visual indication that is keyed to the characteristics of the cartridge.

14. The cartridge according to claim 1 wherein said body member, near said distal end, defines a plurality of generally identical and adjacent lobes disposed to provide a handle to said body member.

15. The cartridge according to claim 14 further including a stabilizing device disposed to communicate with said adjacent lobes to hinder rotation of said body member.

16. The cartridge according to claim 15 wherein:

said adjacent lobes define a groove between each adjacent pair thereof; and said stabilizing device includes:

a guide wire configured to be fixed to said delivery system and extending therefrom toward said adjacent lobes at the distal end of said body member, said guide wire being disposed to communicate and nest within one of said grooves between two adjacent ones of said plurality of lobes.

17. The cartridge according to claim 1 wherein said body member is shaped to complement the shape of an airfoil shaped boom to create an aerodynamic substantially continuous combined shape of said boom and said body member.

18. The cartridge according to claim 1 further comprising:

a plurality of components held within said body member when the cartridge is in use and when the cartridge is being installed and removed from the cartridge retaining fitting.

19. The cartridge according to claim 18 wherein said plurality of components include a sequence of filters.

20. The cartridge according to claim 19 wherein said sequence of filters includes at least one fine filter.

21. The cartridge according to claim 20 wherein said sequence of filters further includes at least one coarse filter.

22. The cartridge according to claim 19 wherein one of said plurality of components is a check valve to prevent leaks and drips from said body member.

23. The cartridge according to claim 22 wherein said check valve includes a ball, a ball seat and a spring.

24. The cartridge according to claim 23 wherein said distal end of said body member includes an inwardly extending shoulder to hold at least a portion of said nozzle tip within said distal end of said body member;

wherein said nozzle tip is held against said shoulder by a first tubular spacer disposed within said interior passage of said tubular body member, wherein said ball and spring are located within an interior passage of said first spacer with said spring being in compression between said nozzle tip and said ball to continually press said ball toward said ball seat and to maintain closure between said ball and ball seat when the pressure of said material to be sprayed applied to said ball through said ball seat is not sufficient to unseat said ball from said ball seat in opposition to the compressive force of said spring.

25. The cartridge according to claim 24 further including a second generally hollow tubular spacer sized and shaped to fit within said body member disposed between said ball seat and said sequence of filters.

26. A multiple branch nozzle assembly comprising:

a T-shaped fitting having a first branch, a second branch and a third branch;

said first branch defining a longitudinal central axis thereof and being disposed to be connected to a fluid supply system, and when so connected being able to swivel 360 degrees around said central axis;

said second branch disposed to connect to a cartridge that includes a nozzle tip, and is configured to include a cartridge retaining fitting, the retaining fitting being configured to couple with the cartridge and hold and seal to the cartridge in use such that the engagement of the cartridge is completed by the application of a force along a cartridge receiving axis of the cartridge retaining fitting by pressing the cartridge toward the cartridge retaining fitting along the cartridge receiving axis and thereby holding said cartridge, said hold and seal being achieved without the necessity of simultaneously applying a twisting torque, the cartridge is held by the cartridge receiving fitting, and the retaining fitting is configured to uncouple from the cartridge by applying a release force to a release portion of the retaining fitting to uncouple the cartridge from the retaining fitting so that the cartridge can move along said cartridge receiving axis away from said retaining fitting without the necessity of simultaneously applying a twisting torque, said cartridge comprising:

an elongated tubular body member defining an interior passage therethrough wherein said body member has a proximal end configured to form a uniform tubular section to engage and be retained by the cartridge retaining fitting and when so engaged and retained to seal the interior passage for the material to be sprayed between the cartridge retaining fitting and an interior passage of said tubular body member and a distal end configured to hold a nozzle tip in communication with said interior passage of said body member and in a particular orientation with respect to said body member when the cartridge is in use and when the cartridge is being installed and removed from the cartridge retaining fitting said third branch is connected to an actuator cartridge.

27. A multiple branch nozzle assembly comprising:

a fitting having a first branch, a second branch, and a third branch;

said first branch defining a longitudinal central axis thereof and being disposed to be connected to a fluid supply system, and when so connected being able to swivel 360 degrees around said central axis;

said second branch disposed to connect to a cartridge that retains a nozzle tip; and said third branch is disposed to be connected to an actuator cartridge, wherein said actuator cartridge is disposed to be connected to a drive linkage mechanism.

28. A spray system including a drive linkage mechanism and a plurality of multiple branch nozzle assemblies, each of said multiple branch nozzle assemblies including:

an actuator;

a cartridge retaining a nozzle tip at its distal end;

a fitting having a first branch, a second branch and a third branch;

said first branch defining a longitudinal central axis thereof and being disposed to be connected to a fluid supply system, and when so connected being able to swivel 360 degrees around said central axis;

said second branch disposed to connect to the exterior of said proximal end of said cartridge; and said third branch being connected to said actuator wherein said actuator is connected to said drive linkage mechanism.

29. A spray system according to claim 28 wherein:

said first and second branches of said fitting define a cross-bar of a T shape with said nozzle tip pointed in a general direction toward an item to which a spray is to be directed from said nozzle tip;

said nozzle tip produces a generally elliptical spray pattern therefrom;

said spray system further includes a rotational control system coupled to said first branch of said fitting to selectively rotate said first branch and to position said nozzle tip to control the pattern of the spray delivered to said item from said nozzle tip by the rotation of said generally elliptical spray pattern produced from said nozzle tip.

30. In combination with a delivery system for a material to be selectively sprayed, said system including a quick release coupling, a spray nozzle cartridge matably insertable in said quick release coupling, where the coupling of the spray nozzle cartridge is accomplished solely by the application of a force alonq an axis of said cartridge by pressing the cartridge toward the quick release coupling without the necessity of simultaneously applying a twisting torque, the cartridge comprising:

an elongated tubular body member defining a passage for fluid, said body member having a proximal end configured to form a tubular section to engage and be retained by the quick release coupling and seal a fluid passage for a material to be sprayed between the quick release coupling and said passage for fluid and a distal end;

wherein said distal end is disposed to extend beyond said quick release coupling to provide access for external manipulation and to hold a spray nozzle tip in communication with said passage for fluid within said inner wall when the cartridge is in use and when the cartridge is being installed and removed from the quick release coupling.

31. A spray nozzle assembly comprising:

a quick release coupling having a longitudinal axis, said coupling including two coupling ends a male coupling end and a female coupling end, said coupling ends being joinable to form a continuous sealed passage through said coupling solely by providing an axial force along said axis to bring said male coupling end into engagement with said female coupling end without requiring any twisting motion between ends, wherein a nozzle tip is configured to be held connected to and in communication with a fluid passage of one of said two coupling ends when the coupling is in use and when the two coupling ends are being joined and separated from one another, while a second of said coupling ends is connected to a source of fluid to be sprayed;

wherein the one of the two coupling ends holding the nozzle tip is configured when joined to provide access to the one of the two coupling ends holding the nozzle tip to rotate the coupling end holding the nozzle tip.

32. A spray nozzle assembly as in claim 31 wherein after engagement said coupling ends can be separated by providing a force in an axial direction on a collar of a telescoping neck of a first of said two coupling ends and by providing a separating force in an axial direction between the two coupling ends causing disengagement of the two pieces.

33. A spray nozzle assembly as in claim 32 wherein said male coupling end includes a generally smooth cylindrical outer surface which is engaged by said female coupling end during engagement.

34. A spray nozzle assembly as in claim 32 wherein the one of two coupling ends containing said spray nozzle can be manually rotated without tools to rotate the spray nozzle around the coupling axis.

35. A spray nozzle assembly as in claim 31 wherein said male coupling end includes a generally smooth cylindrical outer surface which is engaged by said female coupling end during engagement.

36. A spray nozzle assembly as in claim 31 wherein the one of two coupling ends containing said spray nozzle can be manually rotated without tools to rotate the spray nozzle around the coupling axis.

* * * * *